US010457008B2

(12) United States Patent
Boivin et al.

(10) Patent No.: US 10,457,008 B2
(45) Date of Patent: Oct. 29, 2019

(54) MODULAR SCREW PRESS

(71) Applicant: Rio Tinto Alcan International Limited, Montreal (CA)

(72) Inventors: Alain Boivin, Labaie (CA); Deane Labrum, Forest Lake (AU); Guy Simard, La Malbaie (CA); Pascal Vandal, Chicoutimi (CA)

(73) Assignee: Rio Tinto Alcan International Limited, Montreal, Quebec (CA)

( * ) Notice: Subject to any disclaimer, the term of this patent is extended or adjusted under 35 U.S.C. 154(b) by 439 days.

(21) Appl. No.: 15/303,996

(22) PCT Filed: Apr. 9, 2015

(86) PCT No.: PCT/IB2015/000469
§ 371 (c)(1),
(2) Date: Oct. 13, 2016

(87) PCT Pub. No.: WO2015/162473
PCT Pub. Date: Oct. 29, 2015

(65) Prior Publication Data

US 2017/0036410 A1 Feb. 9, 2017

(30) Foreign Application Priority Data

Apr. 22, 2014 (EP) ..... 14001432

(51) Int. Cl.
*B30B 9/12* (2006.01)
*B30B 9/26* (2006.01)

(52) U.S. Cl.
CPC ..... *B30B 9/121* (2013.01); *B30B 9/26* (2013.01)

(58) Field of Classification Search
CPC .. B30B 9/12; B30B 9/121; B30B 9/26; B30B 9/06

(Continued)

(56) References Cited

U.S. PATENT DOCUMENTS 4,384,955 A * 5/1983 Nakakura ..... B30B 9/26 100/117
4,446,778 A 5/1984 Molnar
(Continued)

FOREIGN PATENT DOCUMENTS

GB 310680 A 5/1929
WO 0220257 A1 3/2002

OTHER PUBLICATIONS

Jul. 10, 2015—(CA) International Search Report PCT/IB2015/000469.

*Primary Examiner* — Elaine Gort
*Assistant Examiner* — Christopher B Wehrly
(74) *Attorney, Agent, or Firm* — Banner & Witcoff, Ltd.

(57) ABSTRACT

A screw press includes a filter casing having inlet and outlet sections and a filter section therebetween. A screw is mounted in the casing for conveying a solid-liquid mixture from the inlet section to the outlet section while compressing the solid-liquid mixture and forcing at least part of a liquid content thereof to be expelled out of the filter casing. The casing and the screw are of modular construction. The filter section has at least first and second serially interconnectable filter sections, and the screw has at least first and second serially interconnectable screw sections respectively disposed in the first and second filter sections for joint rotation as a unitary component. The first and second screw sections have a continuous screw flight having a flight outside diameter. The first and second screw sections are detachably coupled to one another by a coupling provided at the outside diameter of the flight.

14 Claims, 5 Drawing Sheets

(58) Field of Classification Search
USPC ..... 100/117, 128, 129, 145; 198/666; 210/413, 414, 415
See application file for complete search history.

(56) References Cited

U.S. PATENT DOCUMENTS 4,446,788 A * 5/1984 Molnar ..... B30B 9/26 100/117
5,630,669 A * 5/1997 Stewart ..... F16C 19/26 384/570
7,344,033 B2 * 3/2008 Sasaki ..... B01D 29/46 100/117

* cited by examiner

MODULAR SCREW PRESS

CROSS-REFERENCE TO RELATED APPLICATIONS

This application is a U.S. National Stage application under 35 U.S.C. § 371 of International Application No. PCT/IB2015/000469 (published as WO 2015/162473 A1), filed Apr. 9, 2015, which claims priority to European Patent Application No. 14001432.5, filed Apr. 22, 2014, and the present application claims priority to and the benefit of both of these prior applications, each of which is incorporated by reference in its entirety.

TECHNICAL FIELD

The present invention relates generally to solid-liquid separation equipment and, more particularly, to a screw press for dewatering a slurry.

BACKGROUND OF THE ART

Screw presses are well known. Conventional screw presses typically have a single configuration adapted for a specific separation process without being adaptable to other kinds.

Modular screw presses have also been developed. Such modular screw presses generally comprises separate sections adapted to be assembled to one another. While known modular screw presses provide for wider ranges of applicability, the reconfiguration thereof typically requires complete removal of the screw press from the process line and, then, disassembly of the screw press. This requires the complete shutdown of the process line and, thus, results in significant downtime.

Accordingly, there is a need to provide a new modular screw press which can be easily assembled and disassembled while insuring the integrity of the screw press.

SUMMARY

It is therefore an object to facilitate the maintenance and reconfiguration of a screw press.

In accordance with a general aspect of the present invention, there is provided a screw press for separating liquid from a solid-liquid mixture, said screw press comprising: a generally tubular body having axially spaced-apart inlet section and outlet section, and a filter section between said inlet section and outlet section; said filter section having liquid passages; and a rotatable screw mounted in said tubular body for conveying the solid-liquid mixture from the inlet section to the outlet section while compressing the solid-liquid mixture and forcing at least part of a liquid content thereof to be expelled out of the tubular body through said liquid passages of said filter section; characterized in that the generally tubular body and the rotatable screw are both of modular construction, the filter section of the tubular body comprising at least first and second serially interconnectable filter sections, the rotatable screw having at least first and second serially interconnectable screw sections respectively disposed in said first and second filter sections for joint rotation as a unitary component, and in that the first and second screw sections have a continuous screw flight having a flight outside diameter, the at least first and second screw sections being detachably coupled to one another by a coupling provided at said outside flight diameter.

In accordance with another aspect of the present invention, there is provided a coupling for joining first and second screw sections of a screw press, the coupling comprising a first coupling member mounted to a first screw flight section at a first end of the first screw section, and a second coupling member mounted to a second screw flight section at a second end of the second screw section, the first and second coupling members being detachably fastenable to one another.

According to a further general aspect, the first and second coupling members comprise respective semi-cylindrical plates mounted to an outside diameter surface of the screw flight on the first and second screw sections; when interconnected, the semi-cylindrical plates forming a support ring about the first and second screw flight sections.

Further details of these and other aspects of the present invention will be apparent from the detailed description and figures included below.

DESCRIPTION OF THE DRAWINGS

Reference is now made to the accompanying figures, in which.

DETAILED DESCRIPTION OF THE PREFERRED EMBODIMENTS

Figure 1:
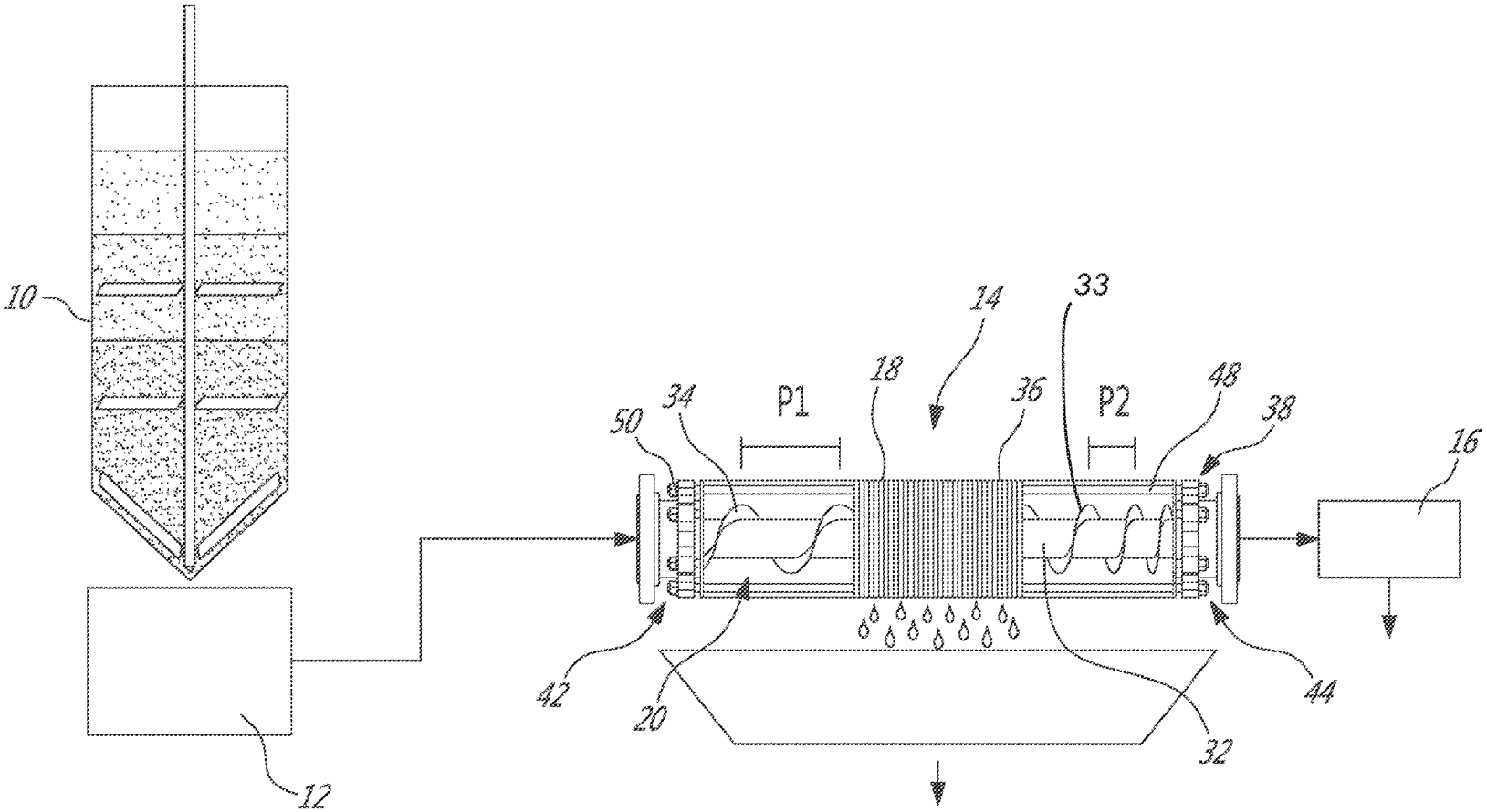
FIG. 1 is a schematic view of a pressure filtration installation in accordance with an embodiment of the present invention.

FIG. 1 is representative of an application to which the principles of the present invention may be applied. More particularly, FIG. 1 illustrates a pressure filtration installation for removing liquid from a solid-liquid mixture. According to one application, the pressure filtration installation is particularly well adapted for dewatering red mud (the residue of Bayer process in the production of alumina from Bauxite ore). However, it is understood that the pressure filtration installation could be configured and use for dehydrating various types of slurry and is, thus, not strictly limited to red mud dewatering applications.

As can be appreciated from FIG. 1, the installation generally comprises a reservoir 10 containing the red mud or slurry to be dehydrated, feeding means, such as a positive displacement pump 12, operatively connected to the reservoir 10 for feeding the slurry under pressure to a screw press 14, and a valve 16 for regulating the flow of dehydrated mud at a discharged end of the screw press 14.

The positive displacement pump is usually combined with means for allowing the delivery of a substantially constant flow rate of slurry at a substantially constant inlet pressure. The input flow rate of slurry can be controlled by the stroke speed of a positive displacement pump. The inlet pressure and flow rate can be maintained during cycle/piston changeover of the positive displacement pump, by a non-return valve (or a check valve) to prevent reverse flow, and by a pressurized dampener, such as a reservoir, to supply slurry during the changeover.

Figure 2:
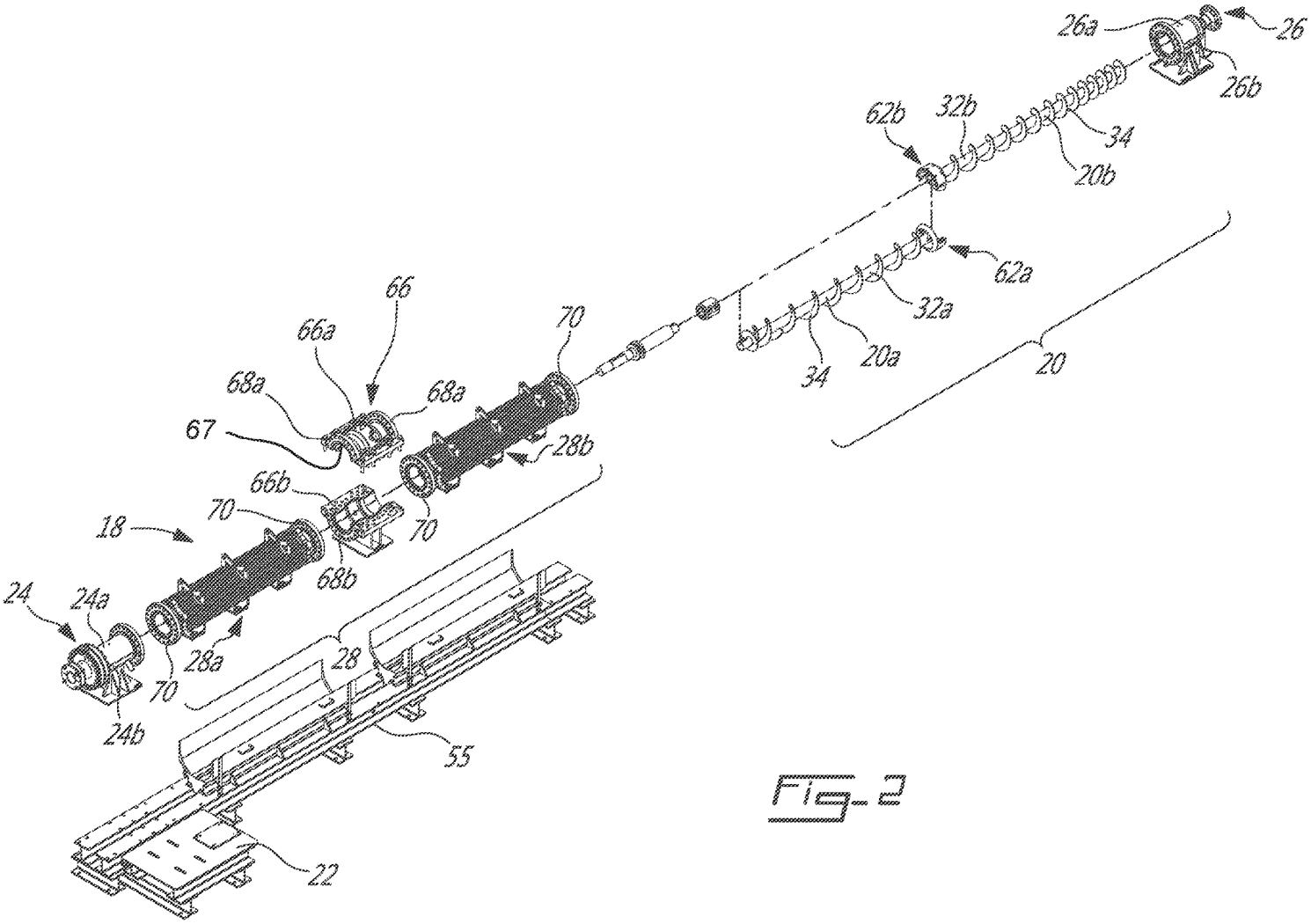
FIG. 2 is an exploded perspective view illustrating construction details of a screw press forming part of the pressure filtration installation shown in FIG. 1.

As shown in FIG. 2, the screw press 14 generally comprises a filter casing having a generally tubular body 18 for surrounding a screw 20 adapted to be rotatably mounted within the tubular body 18. A motor (not shown) is mounted on a platform 22 adjacent to the filter casing for driving the screw 20 via a suitable transmission arrangement, such as a belt transmission or a direct drive (not shown). In operation, the screw 20 applies a longitudinal pressure gradient on the solid-liquid mixture to be dewatered. The pressure of the fed slurry or the slurry supply pressure, for instance at the outlet of the displacement pump 12, causes the liquid to be squeezed out from the mixture and out of the screw press casing as schematically depicted in FIG. 1. In addition to the slurry pressure, the action of the screw 20 on the solid-liquid mixture also causes the liquid to be squeezed out from the mixture and out of the screw press casing. The size of the opening of the outlet valve can be continuously altered to simultaneously maintain the required pressure within the apparatus and to control the outlet flow rate of the dewatered slurry.

As best shown in FIG. 1, the screw 20 generally comprises a shaft 32 and a continuous flight 34 extending helically around a smooth outer surface of the shaft 32. The screw flight 34 has a constant outer flight diameter 33, which is slightly less than an inner diameter of the tubular body of the filter casing by a predetermined flight clearance. According to one embodiment of the present invention, the outer diameter of the shaft 32 is constant along all the length of the screw 20. Still according to this embodiment, the pitch (see P1 and P2 on FIG. 1) of the flight 34 gradually decreases towards the discharge end of the screw press (i.e. in a downstream direction). As a result, the volume between adjacent turns of the screw flight 34 decreases progressively towards the discharge end of the screw press 14, thereby gradually increasing the pressure on the solid-liquid mixture and promoting solid-liquid separation.

As shown in FIG. 2, the tubular body 18 of the filter casing has axially opposed inlet and outlet sections 24, 26, and a filter section 28 between the inlet and outlet sections 24, 26. As schematically illustrated in FIG. 1, the filter section 28 has fluid passages for allowing liquid to be evacuated out of the filter casing as the solid-liquid mixture is being conveyed from the inlet section 24 to the outlet section 26 by the screw 20. The inlet section 24 is operatively connectable in flow communication to the output side of the positive displacement pump 12 for receiving a continuous feed of the slurry at a predetermined pressure. The inlet section 24 is preferably designed for maintaining continuous fluid communication with the tubular body 18. Satisfactory results have been obtained by force-feeding the screw press 14 at a pressure preferably ranging from about 2 $N/mm^2$ (approximately 300 psi) to about 14 $N/mm^2$ (approximately 2000 psi), and more preferably between about 4-10 $N/mm^2$ (approximately 600-1500 psi). It is understood that the feeding pressure may change depending on the size of the screw press 14. The outlet section 26 may have a conical passage section operatively connectable to the valve 16 to regulate the flow of dehydrated sludge coming out from the screw press and to maintain the desired filtering pressure inside the filter casing.

The inlet and outlet sections 24, 26 each include upper and lower half-shell members 24*a*, 24*b*; 26*a*, 26*b* adapted to be bolted to one another to form a complete cylindrical casing section. Bushings or the like (not shown) may be provided in the inlet and outlet sections 24, 26 on the inner surfaces of the half-shell members 24*a*, 24*b*; 26*a*, 26*b* to rotatably support the axially opposed ends of the screw 20.

Figure 3:
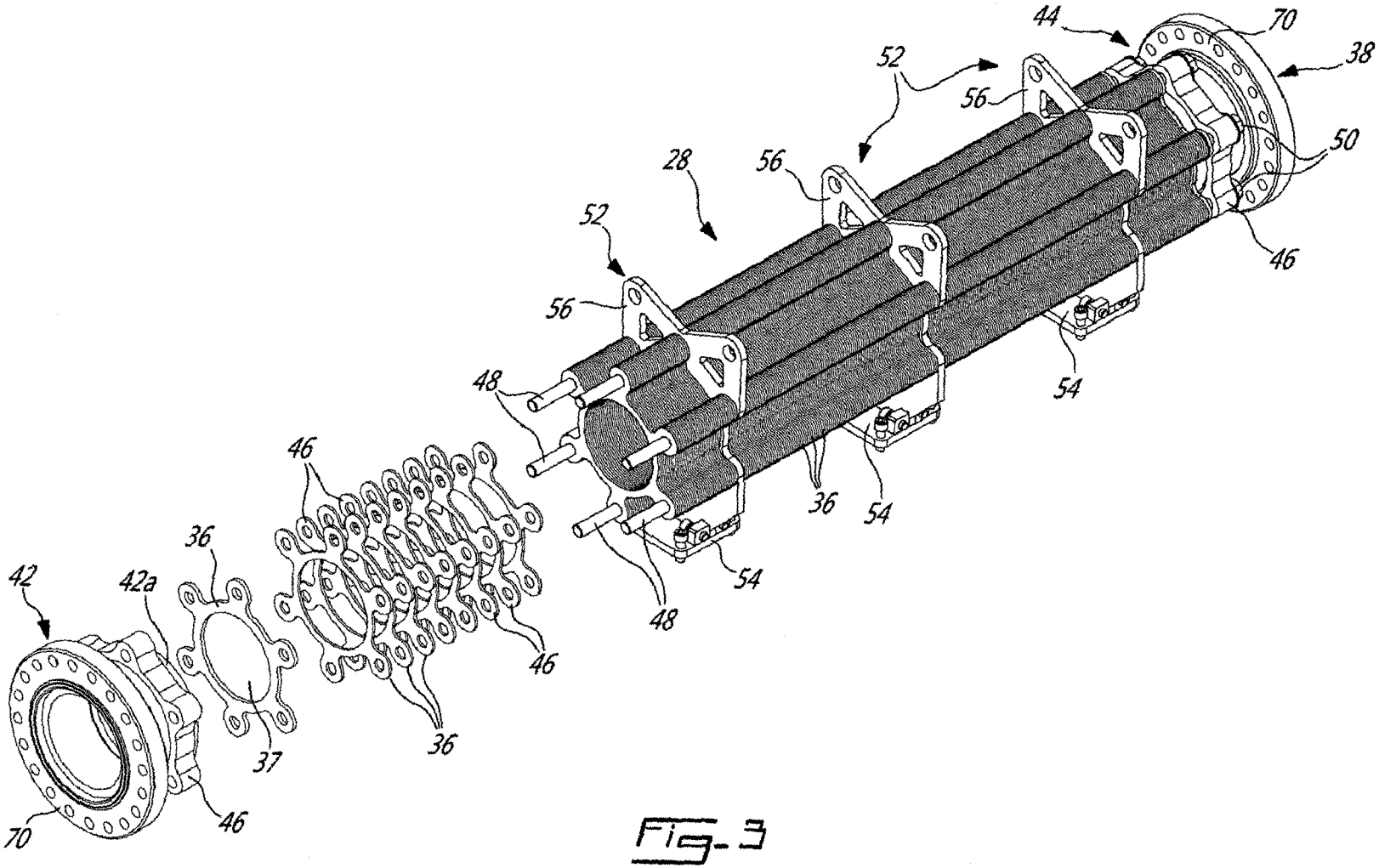
FIG. 3 is a partly exploded perspective view of one of the filter sections of the screw press.
Figures 4, 5:
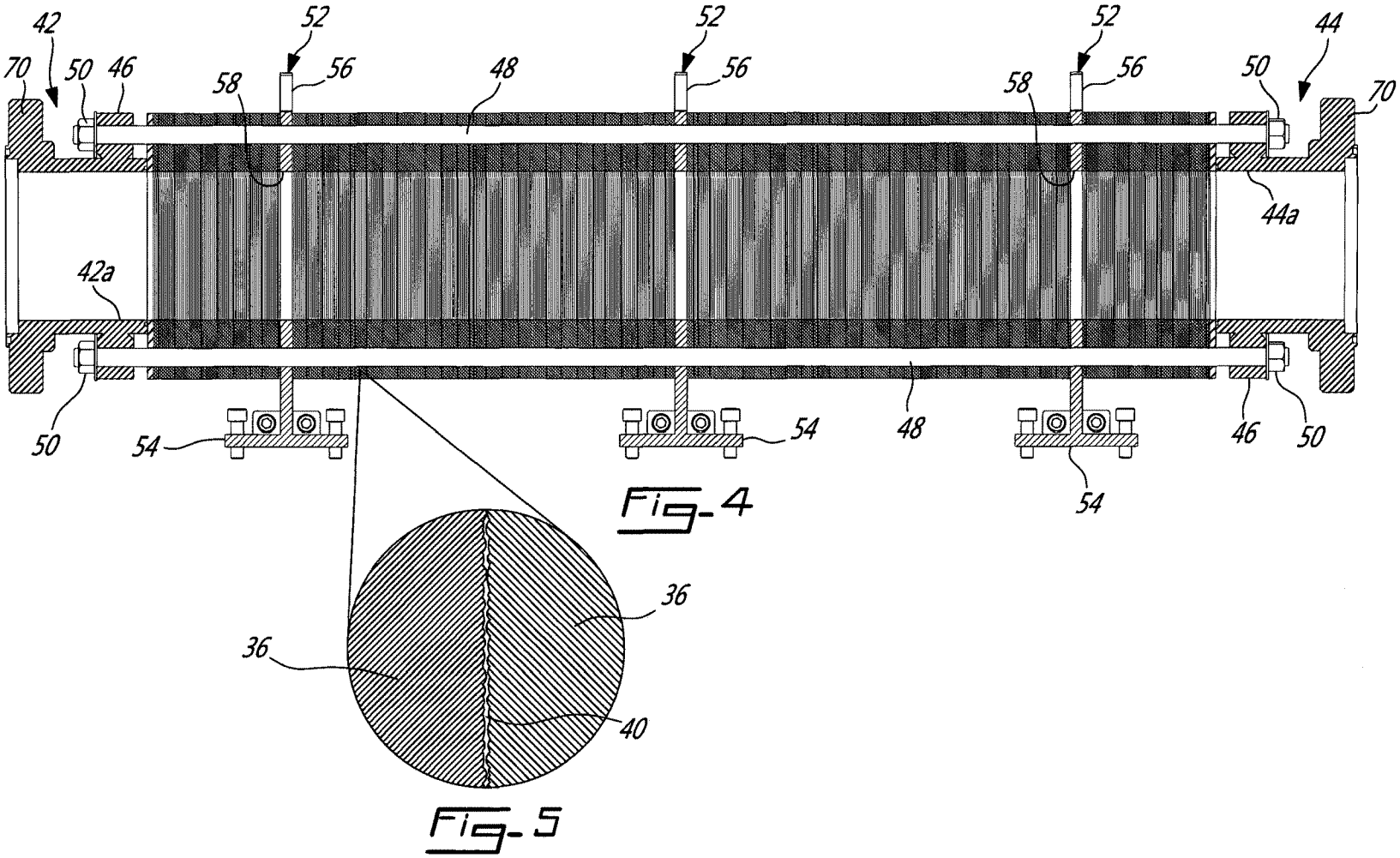
FIG. 4 is a longitudinal cross-section view of the filter section shown in FIG. 3.
FIG. 5 is an enlarged view illustrating an inter-plate gap between two adjacent filtration plates of the filter section shown in FIGS. 3 and 4.

Referring to FIGS. 3 and 4, it can be appreciated that the filter section 28 generally comprises a plurality of stationary filtration plates 36 axially clamped to be preferably continuously maintained in intimate face-to-face contact by a clamping assembly 38 operable for applying a predetermined axial clamping pressure substantially uniformly about an inner diameter of the plates 36. The predetermined axial clamping pressure is preferably maintained constant. Each filtration plate 36 may be provided in the form of a flat disc defining a central hole 37. Once assembled, the central holes 37 of the plates 36 are axially aligned to jointly form an axially extending core passage for receiving the screw 20.

Since the filtration plates 36 are continuously maintained in intimate face-to-face contact, there is no risk that some of the discs be forced apart, which would create preferential passages and results in intermittent decrease of the slurry pressure inside the core passage below the pressure at the outlet of the displacement pump 12. Consequently, there is no risk that small particles, such as the one contained in red mud slurry, could remain stuck between filter discs. It is a significant advantage over the filtration apparatus of the prior art to be able to maintain the slurry pressure inside the screw press of the invention at a relatively constant value. The screw press of the present invention is consequently preferably operated in steady state most of the time.

As will be seen hereinafter, the clamping pressure and the surface roughness of the plates 36 are selected to provide for the formation of a predetermined "micro" inter-plate gap 40 (FIG. 5) between each pair of adjacent plates 36. The inter-plate gap 40 is selected to be sufficiently large to allow the liquid, which has been squeezed out by the screw 20, to percolate between the plates 36, while being sufficiently small to prevent the passage of the solid particles, thereby allowing for the formation of a cake of dehydrated mud on the inner diameter of the filter section 28. Once formed, the solid particle cake contribute to maintain the pressure inside the filter section 28 despite the presence of the inter-plate gaps 40 (i.e. it limits pressure escape through the inter-plate gaps 40). The thickness of the solid particle cake is maintained by the screw, which also acts to trim said cake. Depending on the solid-liquid mixture to be dehydrated, the inter-plate gaps 40 may range from about 1 to about 60, and preferably from about 2 microns to about 20 microns. For red mud dewatering applications, the inter-plate gap 40 is preferably from about 4 microns to about 6 microns and more preferably from about 5 microns to about 6 microns. It can be generally said that the inter-plate gaps 40 are selected to be smaller or in the same order of magnitude than a medium size value of the solid particles contained in the solid-liquid mixture to be processed and sufficiently large to allow liquid percolation.

As mentioned herein above and as schematically illustrated in FIG. 5, each inter-plate gap 40 is function of the surface roughness of the plates 36. The surface roughness (R) of the filtration plates 36 may be defined as the average peak height of the asperities at the surface of the filtration plates 36. When the plates are clamped together, the peaks extending from the opposing faces of the plates 36 prevent the plates from mating in perfect face-to-face sealing engagement, thereby resulting in the formation of micro-passages extending from the inner diameter of the plates 36 to the outer peripheral edge thereof. Depending on the solid-liquid mixture to be dehydrated, filtration plates having a surface roughness ranging from about 1 micron to about 30 microns could be used. Tests have shown that the optimum range of surface roughness for red mud filtration applications is between about 1.4 microns and about 3.5 microns. However, satisfactory results may also be obtained with surface roughness ranging from about 2 microns to about 10 microns. By surface roughness of filtration plates, it is generally meant the surface roughness on the entire surface of both faces of each plate.

The liquid passages of the filter section 28 are formed by inter-plate gaps 40 defined between each pair of adjacent filtration plates 36. The liquid passages extend from the inner diameter of the plates 36 to the outer peripheral edge thereof. The liquid passages surround the core passage defined by the axially extending stack of coplanar filtration plates 36. The filtration plates 36 being maintained clamped, preferably at all time or continuously, in direct intimate face-to-face contact, the resulting liquid passages, which extend from the inner diameter of the plates 36 to the outer peripheral edge thereof, are uniformly distributed around the core passage, thereby preventing the creation of preferential passages.

In other words, the filtration plates 36 are maintained clamped, preferably continuously, in direct intimate face-to-face contact, on a surface that extends from the inner diameter of the plates 36 to the outer peripheral edge thereof, so that the resulting liquid passages are uniformly distributed around the core passage, thereby preventing the creation of preferential passages.

Tactile or optical roughness depth measuring equipment is used to ensure that the plates 36 have the desired surface roughness. Preferably, the plate surface roughness is measured using a contact-type instrument having a stylus adapted to be placed in direct contact with the surface of each of the filtration plates 36. As the stylus traces across a plate, it rises and falls together with the roughness on the plate surface. This movement in the stylus is picked up and used to measure surface roughness.

The filtration plates 36 may be made out of a wide variety of materials, including, for instance: stainless steel, black steel, steel with a baked paint finish, and ceramic. It has been observed that a baked paint finish allows improving the permeability of the filter section 28 while offering a good protection against abrasion and corrosion. The selected material must be able to sustain corrosive environments, stable at the operating temperatures (e.g. 100° C.), and strong enough not to collapse or be subject to compression/deformation over the entire range of clamping pressures applied by the clamping assembly 38. The plate material is also selected so that the fluid flow resistance through the inter-plate gaps 40 is inferior to the resistance of the solid particle cake formed on the inner diameter of the plates 36. In other words, the fluid flow resistance of the filtration plates 36 is selected so that it is less limitative than that of the solid particle cake. It is noted that different materials with different surface roughness may be used to obtain similar liquid flow resistances between the filtration plates 36. For instance, it has been found, while conducting red mud dewatering experimentations, that stainless steel plates with a 1.4 surface roughness and steel plates with a baked paint finish and a surface roughness of 3.5 offer similar liquid flow resistances.

The liquid flow resistance through the inter-plate gaps 40 is also function of the filtration height which corresponds to the distance along which the plates 36 are urged in intimate face-to-face contact between their inner diameter and their outer peripheral edge. The greater the filtration height, the greater the flow resistance through the plates will be. The filtration plates 36 being preferably maintained clamped, at all time, in direct intimate face-to-face contact, the resulting liquid passages extend over the whole filtration height, thereby preventing the creation of preferential passages.

The filtration plates 36 may be subject to various surface treatments to obtain the desired surface roughness and liquid flow resistance. For instance, the plates 36 may be subjected to a bead blasting surface treatment. Glass beads surface treatment is preferred over sand blasting surface treatment. Sand blasting is more abrasive and results in greater surface roughness values than those obtained with glass bead blasting.

Various coatings may be applied to the filtration plates 36 to protect them against corrosion, to change their hydrophobic or hydrophilic properties and/or to alter their surface roughness. For instance, a mixture of paint and particles could be applied over the plates 36 to protect them against corrosion and to obtain a desired surface roughness.

As mentioned herein before, the inter-plate gaps 40 are also function of the clamping pressure applied on the filtration plates 36. The clamping pressure must be applied as uniformly as possible about the core passage defined by the filtration plates 36 in order to avoid leakage. Referring to FIGS. 3 and 4, it can be appreciated that the clamping assembly 38 generally comprises first and second clamping plates 42, 44 respectively provided at opposed ends of the filter section 28 with the filtration plates 36 disposed there between. Each of the first and second clamping plates 42, 44 has a load distribution portion, which may take the form of a ring or cylindrical projection 42*a*, 44*a* extending from one face thereof, for entering in uniform bearing contact with an adjacent one of the filtration plates 36 concentrically about the central hole 37 thereof. Uniformly circumferentially distributed ear sections or eyelet projection 46 extend radially outwardly from the filtration plates 36 and the cylindrical projections 42*a*, 44*a* of the clamping plates 42, 44 for engagement with axially extending stay bolts 48. It is understood that the mounting holes defined by the eyelet projections could be otherwise provided. For instance, mounting holes could be defined directly in the filtering ring surface of the plates 36. At least four, preferably six, sets of eyelets and stay bolts are circumferentially distributed about the core passage defined by the filtration plates 36. Nuts 50 are threadably engaged at opposed distal ends of the stay bolts 48 to axially clamp the stack of filtration plates 36 between the clamping plates 42, 44. The nuts 50 are tighten at a same predetermined torque. A suitable tool, such as a torque wrench, is used to ensure that the exact same torque is applied at each nut 50. According to one application of the present invention, a calibrated tightening torque comprised between about 56 N-m (approximately 500 lbf-in) and about 560 N-m (approximately 5000 lbf-in) is applied on each of the nuts 50. The required torque increases with the size (length and diameter) of the screw press 14. For instance, for a screw having a diameter of about 0.1 m, the clamping torque could be about 56 N-m (approximately 500 lbf-in); whereas for a diameter of 0.3, the clamping torque could be in the vicinity of 225 N-m (approximately 2000 lbf-in). The thickness of the clamping plates 42, 44, including the cylindrical projections 42*a*, 44*a* and the eyelets 46 or ear sections, is selected to avoid any deformation under such tightening conditions. This is why the clamping plates 42, 44 are much thicker than the filtration plates 36. This allows to ensure uniform pressure distribution on the plates between adjacent nuts 50 and, thus, about the circumference of the central hole 37 of the filtration plates 36. It is understood that the value of the torque will vary depending on the size/geometry of the filtration plates 36. The torque is selected to generally correspond to a clamping pressure of between about 1.4 $N/mm^2$ (approximately 200 psi) and about 3.5 $N/mm^2$ (approximately 500 psi), and preferably between about 2 $N/mm^2$ (approximately 300 psi) and about 2.8 $N/mm^2$ (approximately 400 psi) on each of the filtration plates 36.

The clamping pressure applied on the filtration plates 36 is such that the filtration plates are maintained clamped, preferably at all time or continuously, in direct intimate face-to-face contact.

As shown in FIGS. 3 and 4, at least one intermediate support plate 52 (three in the illustrated example) is interposed between two adjacent filtration plates 36. The number of support plates 52 will vary depending on the axial length of the filter section 28. The supports plates 52 are inserted at predetermined intervals along the axial length of the filter section 28 to provide uniform support and prevent deformation of the stack of filtration plates 36 under the clamping forces applied thereon by the clamping plates 42, 44. The support plate 52 contributes to solidify the plate assembly while providing a bottom mounting interface or foot 54 for fastening the filter section 28 to an underlying frame structure 55 (FIG. 1). Also, the intermediate support plate 52 may be provided at an upper end thereof with a pair of ear projections 56 for facilitating handling and transportation of the assembled filter section 28. Mounting holes are also defined in the intermediate support plate for engagement on the stay bolts 48. The intermediate support plate 52 is thicker than the filtration plates 36. It offers a stable and uniform bearing surface for the adjacent filtration plates 36 and, thus, contributes to maintain a uniform clamping pressure across the whole filtration plate assembly. Like the filtration plates 36, each intermediate support plate 52 has a central hole 58 defining a portion of the core passage of the filter section 28. The intermediate support plate 52 typically has the same surface roughness as the filtration plates 36. Accordingly, the filtration gaps on opposed sides of each intermediate support plate 52 are similar to inter-plate gaps 40 between adjacent filtration plates 36.

The above described embodiment of the pressure filtration installation allows improving the compaction of the solid-liquid mixture. That is more liquid can be extracted from the mixture. For red mud dewatering applications, tests have shown that the dehydrated mud may be 70% to 75%, and sometime up to 77% solid in terms of weight at its exit from the outlet section 26 of the screw press 14. For calcium fluoride (CaF2) dewatering applications, tests have shown that the dehydrated mud may be up to 80% solid in terms of weight at its exit from the outlet section 26 of the screw press 14. For iron tailing dewatering applications, tests have shown that the dehydrated mud may be up to 89% solid in terms of weight at its exit from the outlet section 26 of the screw press 14. This is an improvement of about 20% over conventional red mud gravity decanting processes. It can generally be said that the pressure filtration apparatus allows to increase the solid fraction of compacted slurry discharged from the outlet section of a screw press, while maximizing the solid-liquid separation rate.

As can be appreciated from FIG. 2, the tubular body 18 and the screw 20 can be of modular construction. According to the illustrated example, the tubular body 18 has first and second serially interconnectable filter sections 28*a*; 28*b* and the screw 20 has corresponding first and second serially interconnectable screw sections 20*a*, 20*b* adapted to be respectively mounted in the first and second filter sections 28*a*, 28*b* for joint rotation as a unitary component. However, it is understood that the tubular body 18 and the screw 20 could comprise more than two sections.

Figure 6:
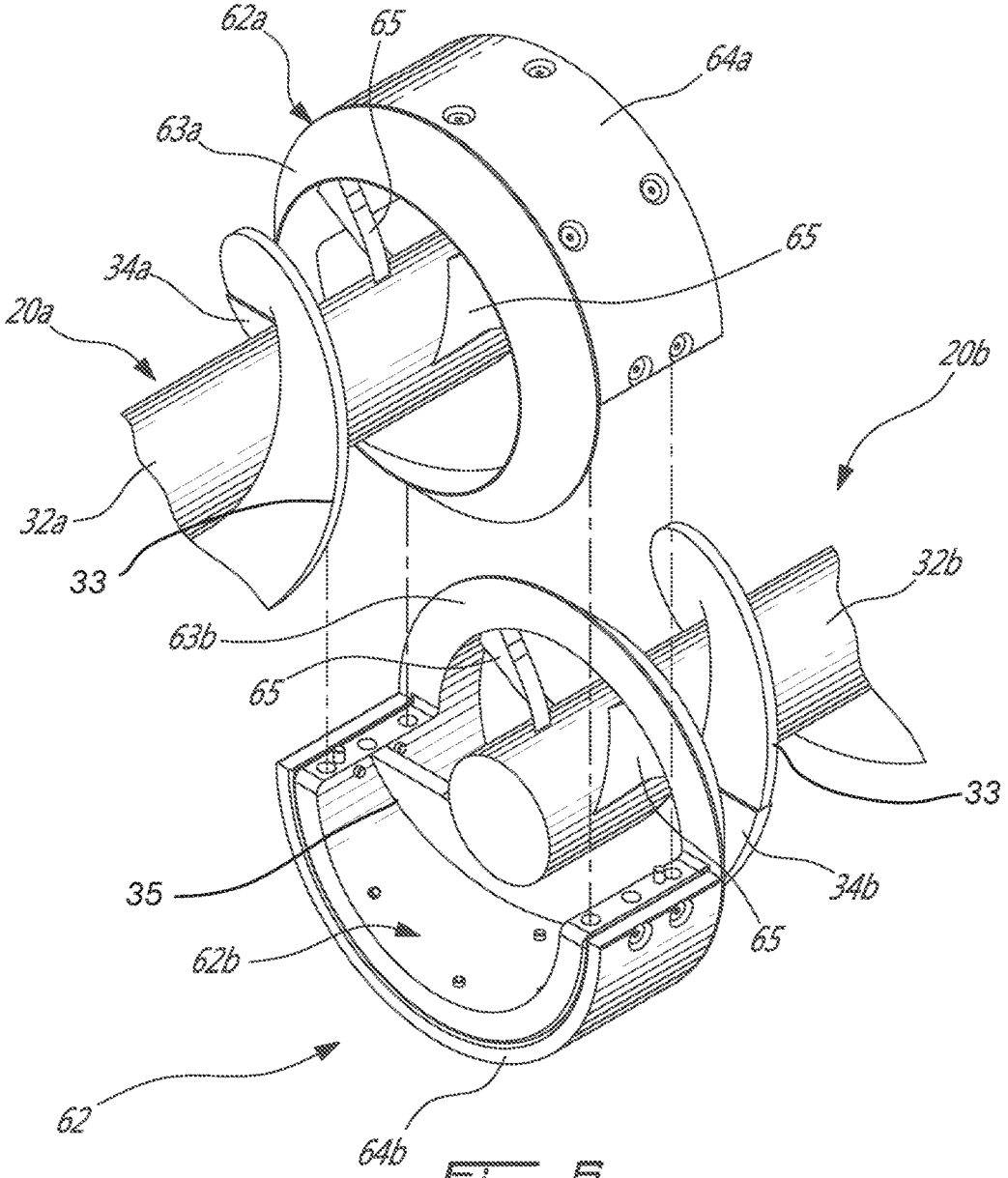
FIG. 6 is a perspective view illustrating the details of an external coupling between two screw sections of the screw press.

The first and second screw sections 20*a*, 20*b* are joined together so as to have a continuous screw flight with no discontinuities between the sections 20*a*, 20*b* and to ensure that the volume between adjacent turns of the flight 34 at the junction of the two screw sections 20*a*, 20*b* is not reduced by the coupling 62. As shown in FIG. 6, the screw sections 20*a*, 20*b* are detachably coupled to one another by an external coupling 62 provided at the outside diameter 33 of the flight 34. Typically, screw sections are coupled via their shafts. Such shaft coupling arrangements may in some instances require that the shafts be reinforcement at their junction, thereby resulting in a reduction of the slurry compression volume between adjacent flight turns at the transition from one shaft section to the next. Accordingly, in order not to be intrusive, it is herein proposed to couple the shaft exteriorly from the volume defined between adjacent turns of the flight, thus maintaining the cross sectional area the slurry passes through, which minimises flow restrictions and reduces the likelihood of blockage.

The coupling 62 generally comprises a first coupling member 62*a* mounted to a first screw flight section 34*a* at a distal end of the first screw section 20*a*, and a second coupling member 62*b* mounted to a second screw flight section 34*b* at an adjacent end of the second screw section 20*b*. The first and second coupling members 62*a*, 62*b* are detachably fastenable to one another, such as by bolting.

The first and second coupling members 62*a*, 62*b* may comprise semi-cylindrical plates or ring segments mounted to the outside diameter surface 35 of the screw flight sections 34*a*, 34*b*, respectively. Each of the screw flight sections 34*a*, 34*b* may be provided in the form of a half-flight segment. The inboard end of the semi-cylindrical plates may be integrally provided with a frusto-conical section 63*a*, 63*b* adapted to be interconnected to the associated screw shaft sections 32*a*, 32*b* via strut-like members 65. When interconnected, the semi-cylindrical plates form a complete support ring about the first and second screw flight sections 34*a*, 34*b*, the support ring having an inside diameter corresponding to the outside diameter 33 of the flight 34. Therefore, the coupling 62 does not reduce the volume between flight sections 34*a*, 34*b*. The semi-cylindrical plates may be welded on an inner surface thereof to the outside diameter surface 35 of the first and second screw flight sections 34*a*, 34*b*. The coupling member 62*a*, the screw flight section 34*a* and associated struts 65 are preferably mounted as a pre-assembled unit to screw shaft section 32*a*. Likewise, the coupling member 62*b*, the screw flight section 34*b* and associated struts 65 are preferably mounted as a pre-assembled unit to screw shaft section 32*b*. According to an embodiment of the present invention, the first and second flight sections 34*a*, 34*b* are welded to the inner surface of the coupling members 62*a*, 62*b* and then the pre-assembled coupling and flight assemblies are subject to a heat treatment process in order to improve the mechanical properties of the coupling assembly. Thereafter, the heat treated coupling and screw flight united pieces are mounted to respective screw shaft sections 32*a*, 32*b* by welding the screw flight sections 34*a*, 34*b* to the outer surface of the shaft and to the end of the existing flight on respective shaft sections 32*a*, and 32*b*. The screw flight sections 34*a*, 34*b* are welded to extend in continuity to the flight already present on the shaft sections 32*a*, 32*b*. The struts 65 are also welded to the screw shaft sections 32*a*, 32*b*.

By welding screw flight sections 34*a*, 34*b* to the coupling members 62*a*, 62*b* prior to the heat treatment process and by then connecting the coupling members 62*a*, 62*b* to the screw shaft sections 32*a*, 32*b*, the structural integrity of the coupling members 62*a*, 62*b* can be preserved. Indeed, welding the coupling members 62*a*, 62*b* directly to flights on the shaft sections 32*a*, 32*b* could potentially negatively affect the mechanical properties of the coupling members 62*a*, 62*b*.

Also as shown in FIG. 6, wear plates 64*a*, 64*b* are removably mounted to the outer surface of each of the semi-cylindrical coupling members 62*a*, 62*b* for engagement with a corresponding segmented wear ring structure 67 mounted in a screw support section 66 (see FIG. 2) disposed between the first and second filter sections 28*a*, 28*b*. Accordingly, the coupling 62 may also be used to provide an intermediate support to the screw 20 generally mid-way between the opposed ends thereof. The screw support section 66 may comprise upper and lower half-shell members 66*a*, 66*b* adapted to be detachably bolted to each other. This ensures ready access to the coupling 62. The segmented wear ring structure 67 provided inside the screw support section 66 is configured to wear out prior to the wear plates 64*a*, 64*b* on the outer surface of the semi-cylindrical plates of the coupling members 62*a*, 62*b*. The upper and lower half-shell members 66*a*, 66*b* are provided at opposed end thereof with bolting flanges 68*a*, 68*b* for attachment with corresponding bolting flanges 70 provided on the clamping plates 42, 44 of each filter sections 28*a*, 28*b*. In this way, each screw and associated filter section 20*a*, 28*a*; 20*b*; 28*b* can be readily removed as a unit or cartridge and replaced by a similar screw and filtration "cartridge" by simply unbolting flange 70 from flanges 68*a*, 68*b*, unbolting the top half-shell member 66*a*, unbolting the screw coupling members 62*a* and 62*b* and unbolting the flange 70 at the other end of the screw and filter section to be replaced. All the bolts, including the bolts used to secure the first and second screw coupling members 62*a* and 62*b*, are easily accessible.

The above description is meant to be exemplary only, and one skilled in the art will recognize that changes may be made to the embodiments described without departing from the scope of the invention disclosed. Modifications which fall within the scope of the present invention will be apparent to those skilled in the art, in light of a review of this disclosure, and such modifications are intended to fall within the appended claims.

What is claimed is:

1. A screw press for separating liquid from a solid-liquid mixture, said screw press comprising:

a generally tubular body having axially spaced-apart inlet section and outlet section, and a filter section between said inlet section and outlet section; said filter section having liquid passages; and a rotatable screw mounted in said tubular body for conveying the solid-liquid mixture from the inlet section to the outlet section while compressing the solid-liquid mixture and forcing at least part of a liquid content thereof to be expelled out of the tubular body through said liquid passages of said filter section;

characterized in that the generally tubular body and the rotatable screw are both of modular construction, the filter section of the tubular body comprising at least first and second serially interconnectable filter sections, the rotatable screw having at least first and second serially interconnectable screw sections respectively disposed in said first and second filter sections for joint rotation as a unitary component, and in that the first and second screw sections have a continuous screw flight having a flight outside diameter, the at least first and second screw sections being detachably coupled to one another by a coupling provided at said flight outside diameter.

2. The screw press defined in claim 1, characterized in that a screw support section is mounted between said first and second filter sections, said coupling being rotatably supported within said screw support section.

3. The screw press defined in claim 1, characterized in that the coupling comprises a first coupling member mounted to a first screw flight section at a first end of the first screw section, and a second coupling member mounted to a second screw flight section at a second end of the second screw section, the first and second coupling members being detachably fastenable to one another.

4. The screw press defined in claim 3, characterized in that the first and second coupling members comprise respective semi-cylindrical plates mounted to an outside diameter surface of the continuous screw flight on the first and second screw sections; when interconnected, the semi-cylindrical plates forming a support ring about the first and second screw flight sections.

5. The screw press defined in claim 4, characterized in that the semi-cylindrical plates are welded on an inner surface thereof to the outside diameter surface of the first and second screw flight sections of the first and second screw sections.

6. The screw press defined in claim 4, characterized in that a screw support section is mounted between said first and second filter sections, said coupling being rotatably supported within said screw support section, and in that wear plates are removably mounted to an outer surface of each of the semi-cylindrical plates for engagement with a corresponding segmented wear ring structure mounted in the screw support section.

7. The screw press defined in claim 6, characterized in that the segmented wear ring structure is configured to wear out prior to the wear plates on the outer surface of the semi-cylindrical plates.

8. The screw press defined in claim 1, characterized in that each of said first and second filter sections comprises a plurality of filtration plates axially clamped in face-to-face contact between first and second clamping plates.

9. The screw press defined in claim 8, characterized in that each of the first and second clamping plates has a load distribution portion in uniform bearing contact with an adjacent one of said filtration plates, said first and second clamping plates being thicker than each of said filtration plates; and in that each of the first and second filter sections further comprises a set of circumferentially distributed stay bolts extending through axially aligned mounting holes defined in the filtration plates and the first and second clamping plates; and nuts threadably engaged at opposed distal ends of the stay bolts.

10. The screw press defined in claim 9, characterized in that the load distribution portion is provided in a form of a ring projecting from an inner face of each of said first and second clamping plates.

11. The screw press defined in claim 8, characterized in that at least one intermediate support plate is interposed between two of the filtration plates, said intermediate support plate being thicker than each of said filtration plates.

12. The screw press defined in claim 2, characterized in that the screw support section has upper and lower half-shell members adapted to be bolted to one another with said coupling therebetween.

13. A method of forming a coupling for a screw press comprising:

a generally tubular body having axially spaced-apart inlet section and outlet section, and a filter section between said inlet section and outlet section; said filter section having liquid passages; and a rotatable screw mounted in said tubular body for conveying a solid-liquid mixture from the inlet section to the outlet section while compressing the solid-liquid mixture and forcing at least part of a liquid content thereof to be expelled out of the tubular body through said liquid passages of said filter section;

wherein the generally tubular body and the rotatable screw are both of modular construction, the filter section of the tubular body comprising at least first and second serially interconnectable filter sections, the rotatable screw having at least first and second serially interconnectable screw sections respectively disposed in said first and second filter sections for joint rotation as a unitary component, and in that the first and second screw sections have a continuous screw flight having a flight outside diameter, the at least first and second screw sections being detachably coupled to one another by the coupling provided at said flight outside diameter, wherein the coupling comprises a first coupling member mounted to a first screw flight section at a first end of the first screw section, and a second coupling member mounted to a second screw flight section at a second end of the second screw section, the first and second coupling members being detachably fastenable to one another, and the first and second coupling members comprise respective semi-cylindrical plates mounted to an outside diameter surface of the continuous screw flight on the first and second screw sections; when interconnected, the semi-cylindrical plates forming a support ring about the first and second screw flight sections;

characterized in that the method comprises welding the first and second screw flight sections respectively to the first and second coupling members and then, submitting the first and second coupling members with the first and second screw flight sections mounted thereon to a heat treatment process.

14. The method defined in claim 13, wherein after the heat treatment process, the method further comprises mounting the first and second coupling members respectively to the first and second screw sections by welding the first and second screw flight sections to respective shafts of said first and second screw sections.

* * * * *